United States Patent [19]

Funahashi

[11] 4,033,257

[45] July 5, 1977

[54] ROTARY DATE STAMP

[76] Inventor: Takaji Funahashi, No. 1, 2-chome, Kitatakasho, Nishi, Nagoya, Aichi, Japan

[22] Filed: Jan. 22, 1976

[21] Appl. No.: 651,255

[30] Foreign Application Priority Data

Feb. 10, 1975 Japan ..... 50-18728[U]
Mar. 19, 1975 Japan ..... 50-37046[U]

[52] U.S. Cl. ..... 101/111; 101/327
[51] Int. Cl.[2] ..... B41J 1/60
[58] Field of Search ..... 101/105–108, 101/327–328, 111, 333, 368; 40/116–118

[56] References Cited

UNITED STATES PATENTS 1,069,192 8/1913 Schmidt ..... 101/111

*Primary Examiner*—Edgar S. Burr
*Assistant Examiner*—A. Heinz

[57] ABSTRACT

A rotary date stamp comprising first rotary members supported rotatably on a fixed shaft, each having an annular disc, a cylindrical shaft supported rotatably on the fixed shaft and having an annular disc, a second rotary member supported on said cylindrical shaft so that it can rotate together with said cylindrical shaft, a third rotary member having an annular disc and being loosely supported on said cylindrical shaft so that it can not rotate together with said cylindrical shaft and endless belts hung around the rotary members and having letters on the surface.

3 Claims, 10 Drawing Figures

FIG. 9
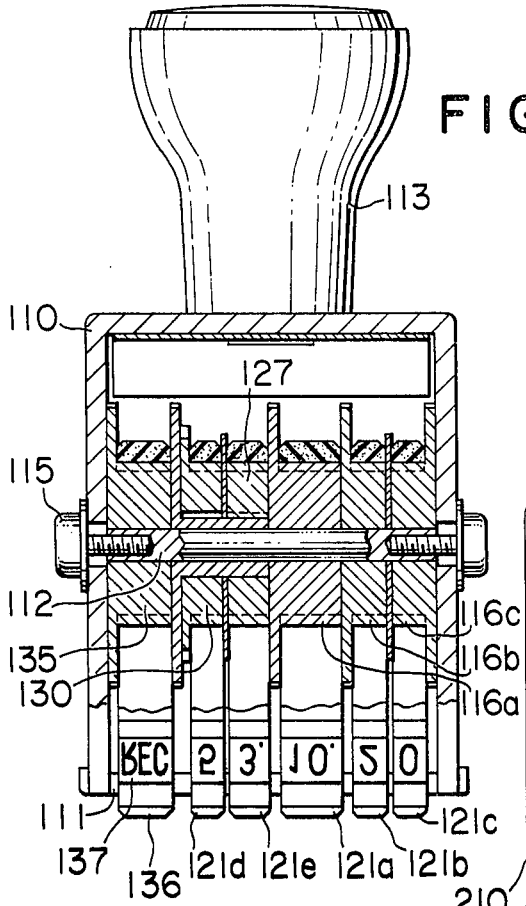
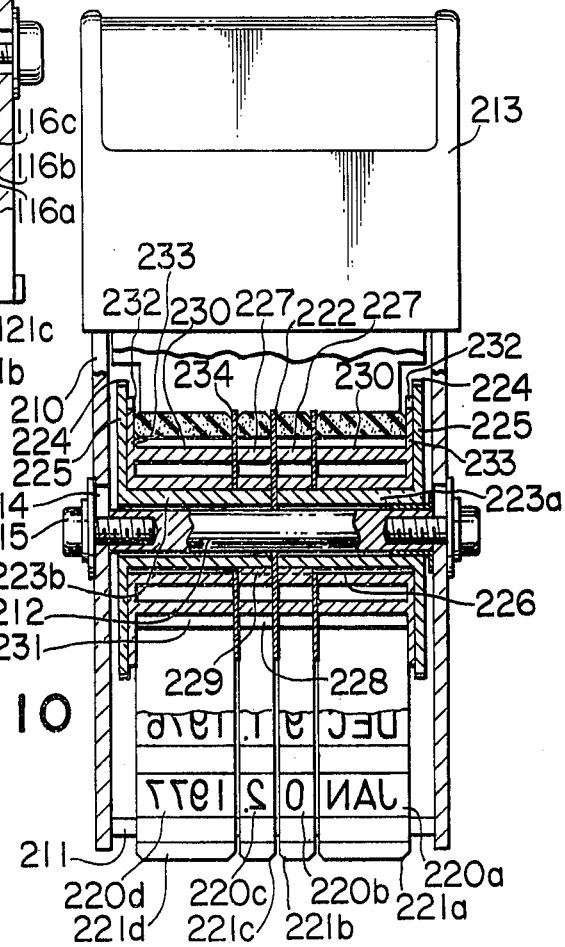
FIG. 10

ROTARY DATE STAMP

This invention relates to a rotary date stamp. More particularly, the invention relates to a rotary date stamp comprising a plurality of date printers of an endless belt-like form which are rotatably hung on a frame.

Conventional rotary date stamps of this type comprise a frame having a substantially reverse U-figured shape, a bridge built on the lower end portions of said frame, a fixed shaft mounted on a substantially intermediate portions of the frame, a plurality of rotary members rotatably supported on said fixed shaft, each rotary member having an annular disc being integrated with one end of the rotary member and having teeth on the periphery thereof, and a plurality of endless belts disposed around said bridge and corresponding rotary members so that said endless belts are hung on the corresponding rotary members, respectively, each endless belt having thereon letters indicating months, days, years or the like.

For example, in a date stamp of this type stamping months, days and years according to the American order, four endless belts are provided. Namely, letters indicating months, i.e., Jan., Feb., — and Dec., are formed on the leftmost first endless belt, letters indicating numbers of tens of days, i.e., 0, 1, 2 and 3, are formed on the second endless belt, letters indicating unit digits of days, i.e., 0, 1, . . . and 9, are formed on the third endless belt, and letters indicating years, i.e., 1975, 1976, ... and 1986, are formed on the fourth endless belt.

In each of the first and second rotary members on which the first and second endless belts are hung, the toothed annular disc is positioned on the left end of the rotary member, and in each of the third and fourth rotary members on which the third and fourth endless belts are hung, the toothed annular disc is positioned on the right end of the rotary member. An annular partition plate of a very narrow width is supported on the fixed shaft between the second rotary member having the second endless belt hung thereon and the third rotary member having the third endless belt hung thereon. Each toothed annular disc is formed to have a relatively large width, so that the operation of rotating it with fingers can be facilitated. Since the width of the annular partition plate is very narrow and the space between the letter indicating the tenth digit of the date and the letter indicating the unit digit is very small, two figures indicating the day can be stamped very clearly. Since each toothed annular disc has a relatively large width and each of the space between letters indicating a month and letters indicating a number of the day and the space between letters indicating a number of the day and letters indicating a year is relatively large, the month, day and year can be stamped so that they can be clearly distinguished from one another.

The first endless belt has 12 groups of letters indicating 12 months, respectively. Accordingly, in general, the fourth endless belt has 12 groups of letters indicating 12 years. Therefore, date stamps of this type can be used only for 12 years from the year when they are manufactured.

In date stamps of the above-mentioned type, each rotary member has a toothed annular disc. Accordingly, it is necessary that the distance between both the legs of the frame of a reverse U-shaped form should be at least the sum of widths of the endless belts and of the annular discs. Therefore, it is impossible to reduce the size of the frame.

The frequency of the use of the first endless belt having letters indicating months is lower than that of the use of the second and third endless belts having letters indicating days. Further, the frequency of the use of the fourth endless belt having letters indicating years is much lower than that of the use of the first endless belt having letters indicating months. It is deemed no good to provide a toothed annular disc having a relatively large width for rotating an endless belt, the frequency of the use of which is very low.

It is a primary object of the present invention to provide a rotary date stamp which can be used over a period of many years.

Another object of the present invention is to provide a rotary date stamp having a much reduced size.

Still another object of the present invention is to provide a rotary date stamp in which a toothed annular disc having a large width need not be provided for a lettered endless belt, the frequency of the use of which is relatively low.

In accordance with one aspect of the present invention, there is provided a rotary date stamp comprising a frame having a substantially reverse U-shaped form, a bridge built on the lower end portions of said frame, a fixed shaft mounted on a substantially intermediate portions of said frame, a plurality of first rotary members supported rotatably on said fixed shaft, each of said first rotary members having an annular disc having teeth on the periphery thereof and being integrated with one end of the first rotary member, at least one cylindrical shaft supported rotatably on said fixed shaft and having an annular disc having teeth on the periphery thereof and integrated with one end of the cylindrical shaft, a second rotary member supported on said cylindrical shaft so that it can rotate together with said cylindrical shaft, a third rotary member having an annular disc having teeth on the periphery thereof and integrated with one end of said third rotary member, said third rotary member being loosely supported on said cylindrical shaft so that it can not rotate together with said cylindrical shaft, a plurality of endless belts, each of which is hung around said bridge and the corresponding rotary member and has on the surface thereof a plurality of letters, and an annular partition plate having a very small width, which is interposed between the second rotary member having the corresponding endless belt hung thereon and the third rotary member having the corresponding endless belt hung thereon and is supported on said cylindrical shaft.

In accordance with another aspect of the present invention, there is provided a rotary date stamp having the above-mentioned structure wherein the annular disc mounted on the cylindrical shaft is smaller in both diameter and width than other annular discs.

In accordance with still another aspect of the present invention, there is provided a rotary date stamp having the above-mentioned structure wherein the annular disc of the third rotary member is smaller in both diameter and width than other annular discs.

In accordance with a still further aspect of the present invention, there is provided a rotary date stamp comprising a frame having a substantially reverse U-shaped form, a bridge built on the lower end portions of said frame, a fixed shaft mounted on a substantially intermediate portions of said frame, two cylindrical shafts supported rotatably on said fixed shaft, each of said cylindrical shafts having a first annular disc having teeth on the periphery thereof and being integrated with one end of the cylindrical shaft, two first rotary members, each of said rotary members being supported on each of said cylindrical shafts so that it can rotate together with said cylindrical shaft, two second rotary members, each of second rotary members being supported loosely on each of said cylindrical shafts so that it can not rotate together with said cylindrical shaft, each of said second rotary members having a second annular disc having teeth on the periphery thereof and integrated with one end of said second rotary member, said second annular discs being smaller in both diameter and width than the first annular discs of said cylindrical shafts, a plurality of endless belts, each of which is hung around said bridge and the corresponding rotary member and has a plurality of letters thereon, an annular partition plate having a very small width and being interposed between said first rotary member having the corresponding endless belt hung thereon and said second rotary member having the corresonding endless belt hung thereon, and another annular partition plate having a very small width and being supported on said fixed shaft and interposed between one cylindrical shaft having supported thereon the corresponding rotary member having the corresponding endless belt hung thereon and the other cylindrical shaft having supported thereon the corresponding rotary member having the corresponding endless belt hung thereon.

The present invention will now be described in detail by reference to embodiments illustrated in the accompanying drawings, in which:

FIG. 9 is a sectional front view of a third embodiment of the present invention; and FIG. 10 is a sectional front view of a fourth embodiment of the present invention.

Figure 1:
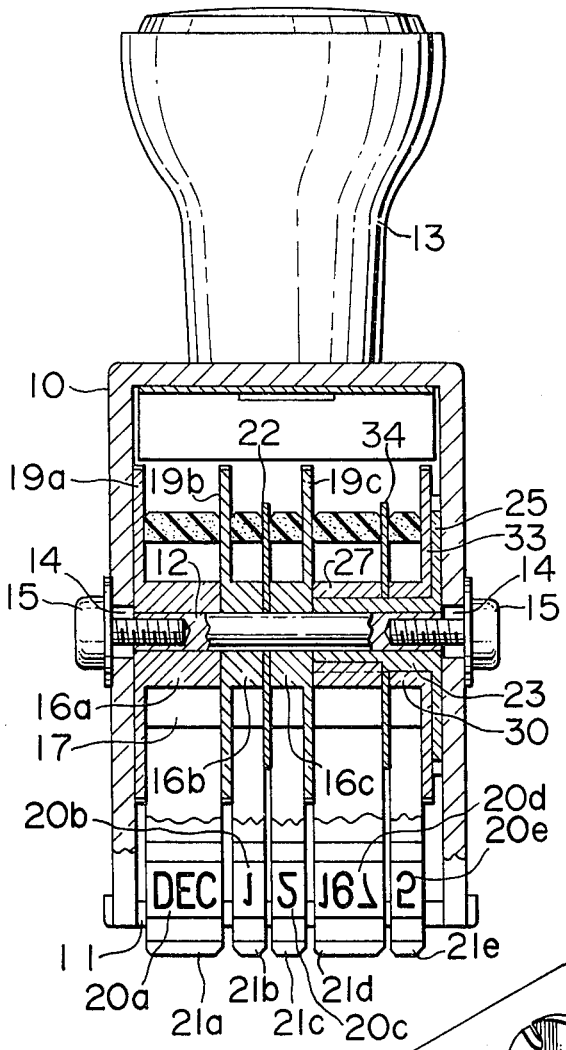
FIG. 1 is a sectional front view of a first embodiment of the present invention.
Figure 2:
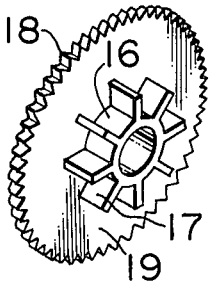
FIG. 2 is a perspective view of the first rotary member of the embodiment shown in FIG. 1.
Figure 3:
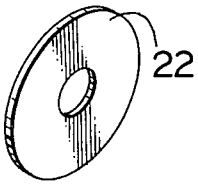
FIG. 3 is a perspective view of the annular partition plate of the embodiment shown in FIG. 1.
Figure 4:
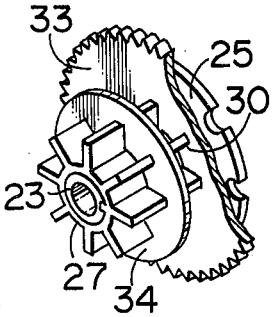
FIG. 4 is a partially cut-out perspective view of the cylindrical shaft, second rotary member, annular partition plate and third member shown in FIG. 1.
Figure 5:
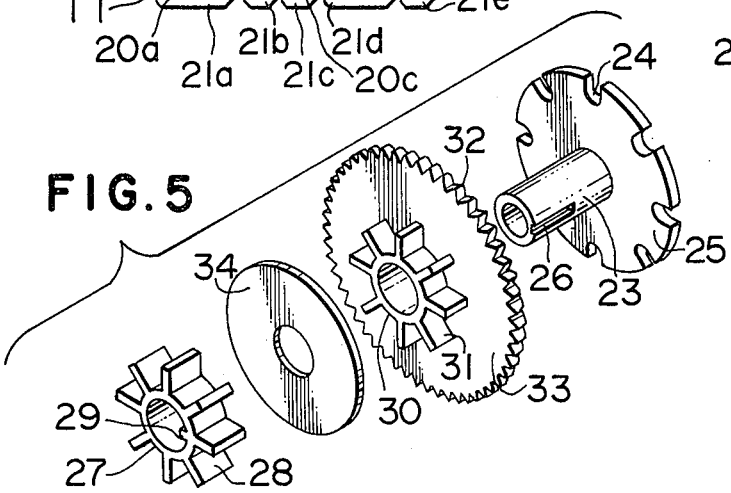
FIG. 5 is a fragmentary perspective view of the members shown in FIG. 4.

Referring now to FIGS. 1 to 5, a frame 10 having a substantially reverse U-shaped form includes a bridge 11 built on the lower end portions thereof, a fixed shaft 12 mounted on a substantially intermediate portions thereof and a handle 13 fixed to the top end thereof. The fixed shaft 12 is fixed to the frame 10 by screwing into both the end portions of the shaft 12 setting screws 15 inserted into holes 14 perforated on substantially intermediate portions of both legs of the frame 10.

Each of a plurality of first rotary members 16 has a cylindrical form and has ridges 17 equidistantly formed on the periphery thereof. An annular disc 19 having many teeth 18 on the periphery thereof is integrated with one end of each first rotary member 16. These first rotary members 16 are supported rotatably on the fixed shaft 12.

In the embodiment shown in FIG. 1, three first rotary members 16*a*, 16*b* and 16*c* are arranged in parallel. The annular discs 19*a* and 19*b* of the leftmost first rotary member 16*a* and the next first rotary member 16*b* are located on the left sides of the corresponding first rotary members, respectively. The annular disc 19*c* of the rightmost first rotary member 16*c* is located on the right side of the first rotary member 16*c*.

Endless belts 21*a*, 21*b* and 21*c* having a plurality of letters 20*a*, 20*b* and 20*c* on the surface thereof are hung around the bridge 11 and the first rotary members 16*a*, 16*b* and 16*c*, respectively. An annular partition plate 22 having a very small width and a diameter smaller than that of the annular disc 19 is supported on the fixed shaft 12 so that the partition plate 22 is interposed between the endless belt 21*b* hung on the first rotary member 16*b* and the endless belt 21*c* hung on the first rotary member 16*c*.

A cylindrical shaft 23 has an annular disc 25 having many teeth 24 on the periphery thereof, and the annular disc 25 is integrated with one end of the cylindrical shaft 23. A key groove 26 is formed on the other end of the cylindrical shaft 23 and the shaft 23 is supported rotatably on the fixed shaft 12.

A second rotary member 27 has a cylindrical form and ridges 28 are formed equidistantly on the periphery of the second rotary member 27. This rotary member 27 has a key 29 on the inner circumference thereof. This key 29 is engaged with the key groove 26 formed on the cylindrical shaft 23, whereby the second rotary member 27 is supported so that it can rotate together with the shaft 23.

A third rotary member 30 has a cylindrical form and ridges 31 are formed equidistantly on the periphery thereof. An annular disc 33 having many teeth on the periphery thereof is integrated with one end of the third rotary member 30. The third rotary member 30 is loosely supported on the cylindrical shaft 23 so that it cannot rotate together with the shaft 23.

In the embodiment illustrated in FIG. 1, the annular disc 25 of the cylindrical shaft 23 is disposed on the right sideof the shaft 23 and the annular disc 33 of the third rotary member 30 is disposed on the right side of the rotary member 30.

The annular disc 25 is smaller in both diameter and width than the annular discs 19 and 33. The diameter and width of the annular disc 19 are the same as those of the annular disc 33.

Endless belts 21*d* and 21*e*, each having a plurality of letters 20*d* and 20*e* on the surface thereof, are hung around the bridge 11 and the second and third rotary members 27 and 30, respectively.

An annular partition plate 34 having a very small width and a diameter smaller than that of the annular disc 33 is supported on the cylindrical shaft 23 so that the annular partition plate 34 is interposed between the endless belt 21*d* hung on the second rotary member 27 and the endless belt 21*e* hung on the third rotary member 30.

Letters 20*a* represent months, i.e., Jan., Feb., . . . and Dec., letters 20*b* represent the tenth digits of days, i.e., 0, 1, 2 and 3, and letters 20*c* represent the unit digits of days, i.e., 0, 1, . . . and 9. Letters 20*d* indicate the 1000th, 100th, and tenth digits of years, i.e., 197, 198, . . . and 208 and letters 20e indicate the unit digits of years, i.e., 0, 1, . . . and 9.

By arranging these letters in the foregoing manner, dates can be stamped according to the American style, for example, Dec. 12, 1975, and the date stamp can be used for about 100 years from the date of manufacture thereof.

The endless belts 21a, 21b, 21c and 21e having letters 20a, 20b, 20c and 20e which are used relatively frequently can be rotated by rotating the annular discs 19a, 19b, 19c and 33 directly with fingers.

The endless belt 21d having letters 20d which are not frequently used can be rotated by pushing the teeth 24 of the annular disc 25 with a thin stick or the like and rotating the disc 25. Since this annular disc 25 is not frequently used, it is not necessary to make the disc 25 have such a large size that it will be rotated directly with fingers. Accordingly, the diameter and width of this disc 25 can be made smaller than those of other annular discs. Therefore, the entire size of the rotary date stamp can be relatively reduced.

Further, since only the partition plate 34 having a very small width is interposed between letters indicating the tenth digits of years and letters indicating the unit digits of years, years can be stamped very clearly as a whole.

Figure 6:
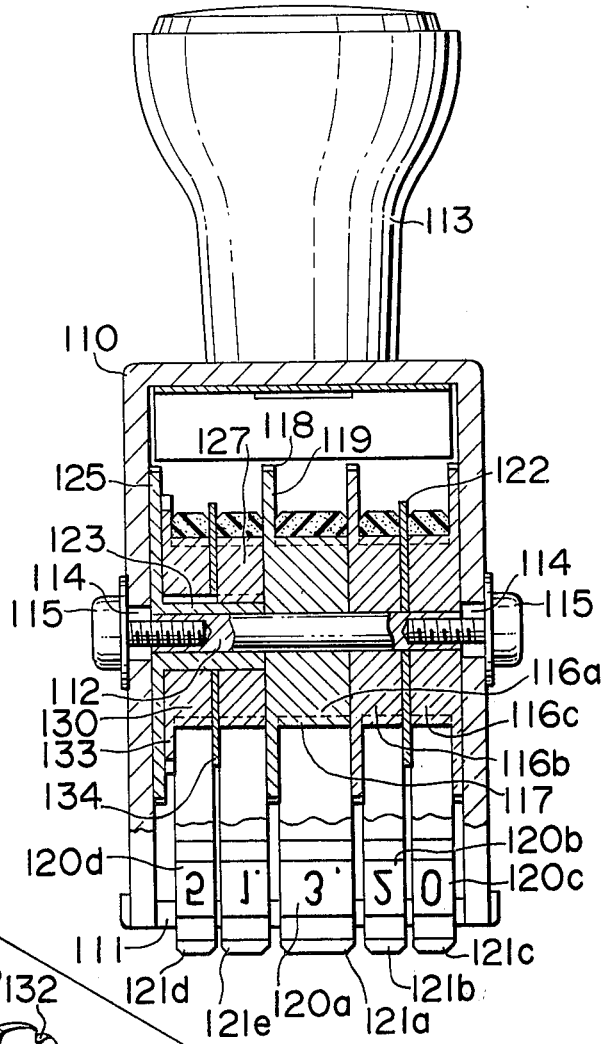
FIG. 6 is a sectional front view of a second embodiment of the present invention.
Figure 7:
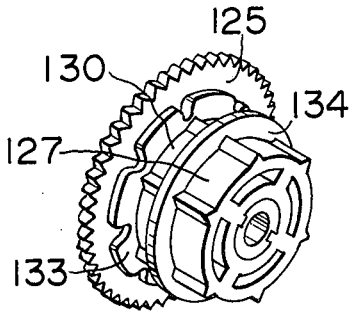
FIG. 7 is a perspective view of the cylindrical shaft, second rotary member, annular partition plate and third rotary member of the embodiment shown in FIG. 6.
Figure 8:
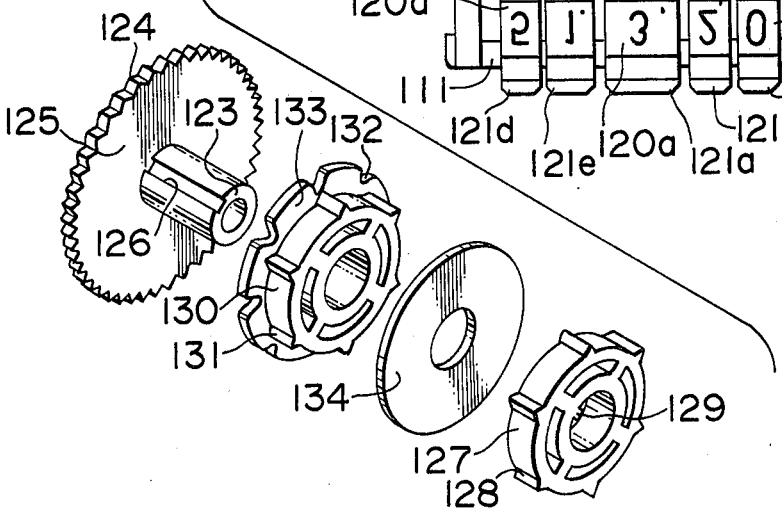
FIG. 8 is a fragmentary perspective view of the members shown in FIG. 7.

In the embodiment shown in FIGS. 6 to 8, dates are stamped according to the Japanese style, for example, Showa, 51, 3, 20. The structure of the rotary stamp of this embodiment is the same as that of the rotary stamp of the embodiment shown in FIG. 1 except the following points.

First rotary members 116a, 116b and 116c are disposed on the right side of a fixed shaft 112, and a cylindrical shaft 123 is disposed on the left side of the fixed shaft 112.

The cylindrical shaft 123 has an annular disc 125 integrated with the left end thereof. A third rotary member 130 has an annular disc 133 integrated with the left end thereof.

The annular disc 133 is smaller than in both diameter and width than other annular discs 119 and 125. The diameter and width of the annular disc 119 are the same as those of the annular disc 125.

An endless belt 121d has letters 120d representing the tenth digits of years.

The embodiment shown in FIG. 9 is the same as the embodiment shown in FIG. 6 except that a similar rotary member 135 and an endless belt 136 hung on the rotary member 135 are further added. This endless belt 136 has appropriate letters 137 for example, "REC." and etc., other than letters indicating dates.

In the embodiment shown in FIG. 10, dates are stamped according to the American style.

This embodiment is the same as the embodiment shown in FIG. 6 except that two cylindrical shafts 223 similar to the cylindrical shaft shown in FIG. 6 are disposed and arrangements of these cylindrical shafts and related members are modified as follows.

Two cylindrical shafts 223a and 223b are symmetrically disposed. Letters 220d indicating all the digits of years are formed on the endless belt 221d.

In this embodiment, endless belts 221b and 221c having letters 220b and 220c indicating numbers of days which are used relatively frequently can be rotated by rotating annular discs 225 directly with fingers, while endless belts 221a and 221d having letters 220a and 220d indicating months and years which are not frequently used can be rotated by pushing teeth 232 of annular discs 233 with a thin stick or the like and rotating them. In this embodiment, since only two of annular discs 225 having a relatively large width are disposed, the size of the rotary date stamp of this embodiment can be made smaller than the size of the rotary date stamp shown in FIGS. 1 to 5.

What is claimed is:

1. A rotary date stamp comprising a frame having a substantially reverse U-shaped form, a bridge built on the lower end portions of said frame, a fixed shaft mounted on substantially intermediate portions of said frame, a plurality of first rotary members supported rotatably on said fixed shaft inside the U-shaped form of said frame, each of said first rotary members having a first annular disc having teeth on the periphery thereof and being fixed to one end each of said first rotary members, said first annular discs being disposed inside the U-shaped form of said frame, a cylindrical shaft supported rotatably on said fixed shaft inside the U-shaped form of said frame and having a second annular disc having teeth on the periphery thereof and fixed to one end of the cylindrical shaft, said second annular disc being disposed inside the U-shaped form of said frame, a second rotary member fixedly supported on said cylindrical shaft so that it can rotate together with said cylindrical shaft, a third rotary member having a third annular disc having teeth on the periphery thereof and fixed to one end of said third rotary member, said third rotary member being loosely supported on said cylindrical shaft, a plurality of endless belts, including first endless belts and a second endless belt, each of said first endless belts being hung around both said bridge and each of said first and third rotary members and having on a surface thereof a plurality of first letters which are frequently used, said second endless belt being hung around said bridge and said second rotary member and having on a surface thereof a plurality of second letters which are not frequently used, an annular partition plate interposed between the second rotary member with said second corresponding endless belt and the third rotary member with said first corresponding endless belt, said annular partition plate having a smaller width than said annular discs, and said second annular disc being smaller in both diameter and width than said first and third annular discs.

2. A rotary date stamp comprising a frame having a substantially reverse U-shaped form, a bridge built on lower end portions of said frame, a fixed shaft mounted on substantially intermediate portions of said frame, a plurality of first rotary members rotatably supported on said fixed shaft inside the U-shaped form of said frame, each of said first rotary members having a first annular disc having teeth on a periphery thereof and being fixed to an end of said first rotary member, said first annular disc being disposed inside the U-shaped form of said frame, a cylindrical shaft rotatably supported on said fixed shaft inside the U-shaped form of said frame and having a second annular disc having teeth on a periphery thereof and being fixed to one end of said cylindrical shaft, said second annular disc being disposed inside the U-shaped form of said frame, a second rotary member fixedly supported on said cylindrical shaft so as to rotate with said shaft, a third rotary member having a third annular disc having teeth on a periphery thereof and being fixed to one end of said third rotary member, said third rotary member being loosely supported on said cylindrical shaft, a plurality of endless belts including first endless belts and a second endless belt, each of said first endless belts being hung around both said bridge and each of said first and third rotary members and having on a surface thereof a plurality of first letters which are frequently used, said second endless belt being hung around said bridge and said second rotary member and having on a surface thereof a plurality of second letters which are not frequently used, an annular partition plate interposed between said second rotary member with the corresponding second endless belt and said third rotary member with the corresponding first endless belt, said annular partition plate having a smaller width than said annular disc, and said third annular disc being smaller in both diameter and width than said first and second annular discs.

3. A rotary date stamp comprising a frame having a substantially reverse U-shaped form, a bridge built on lower end portions of said frame, a fixed shaft mounted on substantially intermediate portions of said frame, two cylindrical shafts rotatably supported on said fixed shaft inside the U-shaped form of said frame, each of said cylindrical shafts having a first annular disc having teeth on a periphery thereof and being fixed to one end of each of said cylindrical shafts, each of said first annular discs being disposed inside the U-shaped form of said frame, two first rotary members, each of said first rotary members being fixedly supported on each of said cylindrical shafts so as to rotate with the respective shafts, two second rotary members, each of said second rotary members being loosely supported on each of said cylindrical shafts and each having a second annular disc having teeth on a periphery thereof and being fixed to one end of said second rotary member, said second annular discs being disposed inside the U-shaped form of said frame and being smaller in both diameter and width than said first annular discs, a plurality of endless belts including first endless belts and second endless belts, each of said first endless being hung around both said bridge and each of said first rotary members and having on a surface thereof a plurality of first letters which are frequently used, each of said second endless belts being hung around said bridge and each of said second rotary members and having on a surface thereof a plurality of second letters which are not frequently used, two first annular partition plates each having a smaller width than said annular discs and being interposed between each of said first rotary members with each of said first endless belts and each of said second rotary members with each of said second endless belts, a second annular partition plate having a smaller width than said annular discs and being interposed between one of said cylindrical shafts with the corresponding rotary members and the corresponding endless belts and the other of said cylindrical shafts with the corresponding rotary members and the corresponding endless belts, said second annular discs being smaller in both diameter and width than said first annular discs.

* * * * *

UNITED STATES PATENT AND TRADEMARK OFFICE

CERTIFICATE OF CORRECTION

PATENT NO. : 4,033,257

DATED : July 5, 1977

INVENTOR(S) : TAKAJI FUNAHASHI

It is certified that error appears in the above-identified patent and that said Letters Patent are hereby corrected as shown below:

Column 6, line 18, after "end" insert --of--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*